US007819759B2

(12) United States Patent
Matsunaga et al.

(10) Patent No.: US 7,819,759 B2
(45) Date of Patent: Oct. 26, 2010

(54) GOLF CLUB HEAD

(75) Inventors: Hideo Matsunaga, Saitama-ken (JP); Makoto Kubota, Saitama-ken (JP); Masaomi Hiruta, Saitama-ken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 19 days.

(21) Appl. No.: 11/860,565

(22) Filed: Sep. 25, 2007

(65) Prior Publication Data

US 2008/0090676 A1 Apr. 17, 2008

(30) Foreign Application Priority Data

Oct. 13, 2006 (JP) ..... 2006-280298

(51) Int. Cl.
*A63B 53/04* (2006.01)

(52) U.S. Cl. ..... 473/346; 473/349

(58) Field of Classification Search ..... 473/345–346, 473/349, 327

See application file for complete search history.

(56) References Cited

U.S. PATENT DOCUMENTS 5,004,241 A * 4/1991 Antonious ..... 473/327
5,193,810 A * 3/1993 Antonious ..... 473/327
5,205,560 A 4/1993 Hoshi et al.
5,255,913 A 10/1993 Tsuchida
5,346,217 A 9/1994 Tsuchiya et al.
5,346,218 A * 9/1994 Wyte ..... 473/346
5,411,255 A * 5/1995 Kurashima et al. ..... 473/332
5,511,786 A * 4/1996 Antonious ..... 473/327
5,755,624 A * 5/1998 Helmstetter ..... 473/291
6,315,678 B1 * 11/2001 Teramoto ..... 473/291
6,595,871 B2 7/2003 Sano
6,783,465 B2 8/2004 Matsunaga
6,949,031 B2 9/2005 Imamoto et al.
7,182,699 B2 2/2007 Matsunaga
7,303,488 B2 * 12/2007 Kakiuchi et al. ..... 473/346
2003/0114244 A1 * 6/2003 Matsunaga ..... 473/345
2004/0254030 A1 12/2004 Nishitani et al.
2005/0049081 A1 * 3/2005 Boone ..... 473/346
2005/0221913 A1 * 10/2005 Kusumoto ..... 473/345
2005/0272527 A1 * 12/2005 Sugimoto ..... 473/345
2006/0014592 A1 * 1/2006 Sugimoto ..... 473/345
2007/0129167 A1 * 6/2007 Matsunaga ..... 473/345

FOREIGN PATENT DOCUMENTS

EP 1 757 337 A1 2/2007

(Continued)

*Primary Examiner*—Stephen L. Blau
(74) *Attorney, Agent, or Firm*—Sughrue Mion, PLLC

(57) ABSTRACT

The present invention provides a golf club head capable of increasing carry on average even if being used by an amateur golfer who is prone to hit a ball by varied hit points of clubface. A golf club head 1 has a face part 2, a crown part 3, a sole part 4, a side part 5, and a hosel part 6, which are formed of titanium or a titanium alloy. A thick part 10 is provided near the central portion in the toe-heel direction of the rear portion of the crown part 3. The distance a between a foremost portion 10*f* the thick part 10 and the foremost portion of the crown part 3 is 20 to 80% of the total length L of the crown part 3.

4 Claims, 3 Drawing Sheets

FOREIGN PATENT DOCUMENTS

| | | | |
|---|---|---|---|
| GB | 2 267 650 | A | 12/1993 |
| JP | 03-126474 | A | 5/1991 |
| JP | 04-089071 | A | 3/1992 |
| JP | 04-135576 | A | 5/1992 |
| JP | 08-126723 | A | 5/1996 |
| JP | 2003-052866 | A | 2/2003 |
| JP | 2003-079768 | A | 3/2003 |
| JP | 2003-088601 | A | 3/2003 |
| JP | 2004-024735 | A | 1/2004 |
| JP | 2004-065660 | A | 3/2004 |
| JP | 2004-222792 | A | 8/2004 |
| JP | 2004-229820 | A | 8/2004 |
| JP | 2005-073736 | A | 3/2005 |
| JP | 2005-160947 | A | 6/2005 |
| JP | 2005-168665 | A | 6/2005 |
| JP | 2005-211438 | A | 8/2005 |
| WO | 2006/014398 | A3 | 2/2006 |

* cited by examiner

GOLF CLUB HEAD

BACKGROUND OF THE INVENTION AND RELATED ART STATEMENT

1. Field of the Invention

The present invention relates to a metallic hollow golf club head and, more particularly, to a large golf club head such as a driver.

2. Description of Related Art

As a wood-type golf club head such as a driver and a fairway wood, metallic hollow golf club heads have been widely used. Generally, hollow wood-type golf club heads have a face part for hitting a ball, a crown part constituting the top surface portion of the golf club head, a sole part constituting the bottom surface portion of the golf club head, a side part constituting the side surface portions on the toe side, back side, and heel side of the golf club head, and a hosel part. In this hosel part, a shaft is inserted and fixed by an adhesive or the like.

As a metal forming the hollow golf club head, an aluminum alloy, stainless steel, or titanium alloy has been used, and especially the titanium alloy has been used widely in recent years.

To increase the shot carry of a metallic hollow golf club head, development for increasing the rebound of the ball by utilizing the deflection (trampolining effect) of the face surface has been carried out.

Also, Japanese Unexamined Patent Application Publication No. 2005-211438 discloses a golf club head in which the carry is increased by making the crown part easily deflectable.

Since the golf rules governing the upper limit of the rebound coefficient have been revised, carry now has to be increased by other measures. In the case of what is called a high-rebound type golf club head utilizing the trampolining effect, although a long carry can be attained when a ball is hit by the face center, such a long carry cannot be obtained when the hit point deviates from the face center.

For the golf club head described in Japanese Unexamined Patent Application Publication No. 2005-211438 as well, if the hit point deviates from the face center, the carry does not increase so sufficiently.

OBJECT AND SUMMARY OF THE INVENTION

An object of the present invention is to provide a golf club head capable of increasing carry on average even if being used by an amateur golfer who is prone to hit a ball by varied hit points of clubface.

A golf club head in accordance with the present invention is characterized in that in a metallic hollow golf club head having a face part, a sole part, a side part, and crown part, a thick part is provided in the central portion in the toe-heel direction of the rear portion of the crown part.

In the golf club head in accordance with the present invention, which is configured as described above, since the thick part is provided in the central portion in the toe-heel direction of the rear portion of the crown part, the deflection of the central portion of the crown part at the ball hit time is restrained, and the deflections on the toe side and the heel side increase relatively. Also, the center of gravity is positioned close to the rear. As the result, even when a ball is hit by the toe side or the heel side of the face surface, the rebounding force can be secured.

For these reasons, even if the golf club head is used by an amateur golfer who often hits a ball by a hit point other than the center of face surface and does not attain so high a head speed, the carry increases on average.

The present invention is suitable for being applied to a large head having a volume of 250 to 460 cc.

DETAILED DESCRIPTION OF PREFERRED EMBODIMENTS

Embodiments of the present invention will now be described with reference to the accompanying drawings.

Figure 1A:
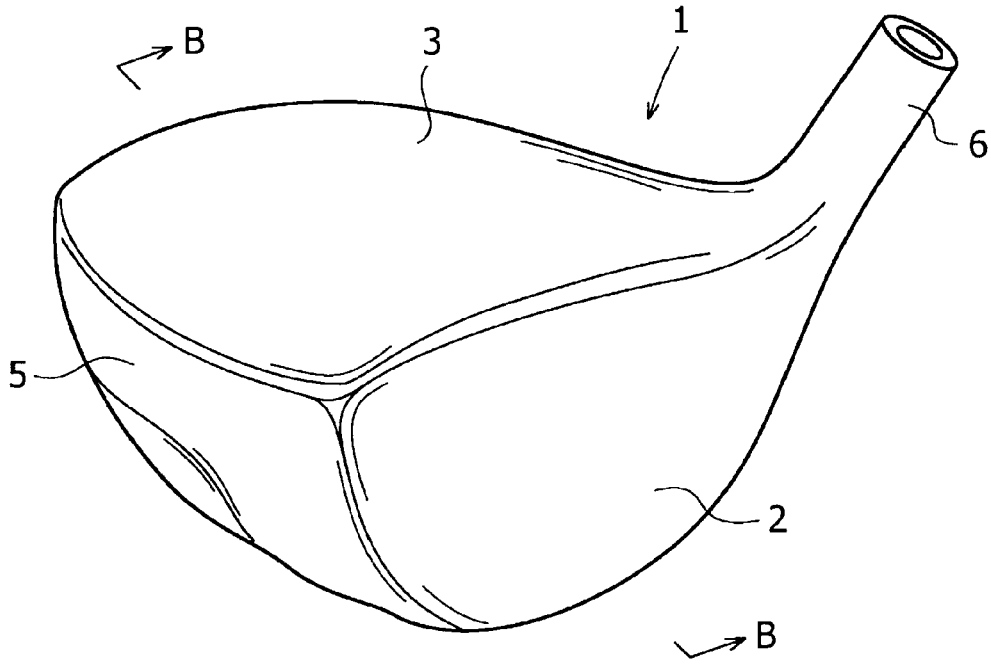
FIG. 1A is a perspective view of a golf club head in accordance with an embodiment of the present invention.
Figure 1B:
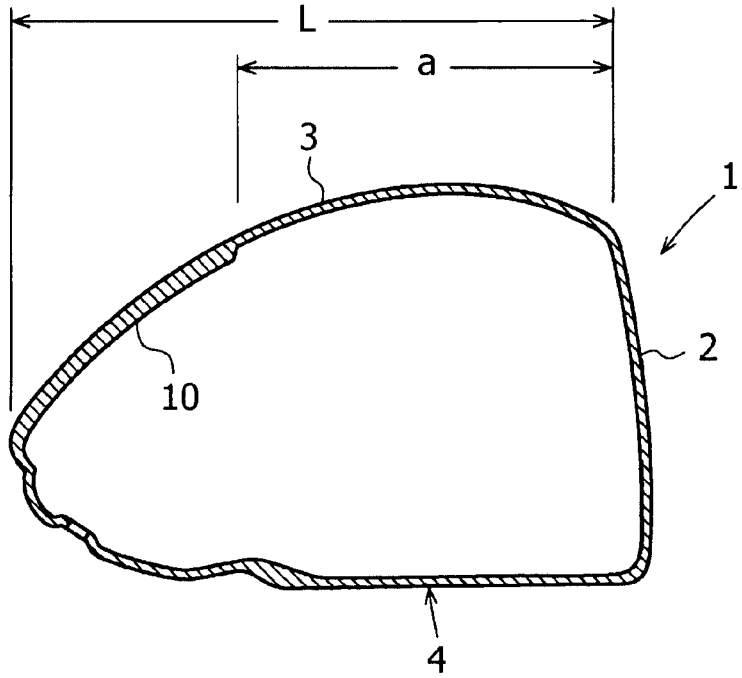
FIG. 1B is a sectional view taken along the line B-B of FIG. 1A.
Figure 2:
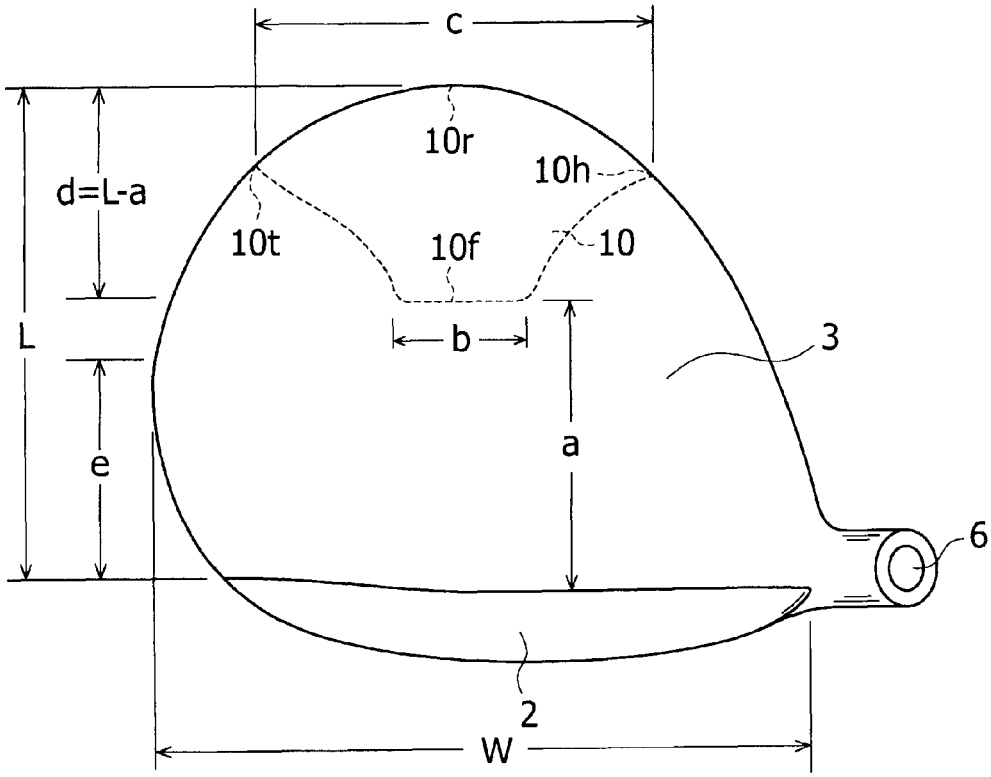
FIG. 2 is a plan view of a golf club head in accordance with an embodiment of the present invention.

FIGS. 1A and 1B are a perspective view and a sectional view, respectively, of a golf club head in accordance with an embodiment, and FIG. 2 is a plan view of the golf club head. In the explanation below, the term "width" means a width in the toe-heel direction.

A golf club head 1 has a face part 2, a crown part 3, a sole part 4, a side part 5, and a hosel part 6.

In the central portion in the toe-heel direction of the rear portion of the crown part 3, a thick part 10 is provided.

A rear end 10*r* of this thick part 10 reaches the rearmost edge portion of the crown part 3. The width of the thick part 10 increases gradually from the foremost portion 10*f* toward the rear, and the thick part 10 reaches the peripheral edge portion of the crown part 3.

In the plan view of the golf club head 1, the distance a between the foremost portion 10*f* the thick part 10 and the foremost portion of the crown part 3 is preferably 20 to 80%, especially 40 to 60%, of the total length L of the crown part 3. Therefore, the distance d (=L−a) is preferably 20 to 80%, especially 30 to 60%, of the length L.

The width b of the foremost portion 10*f* the thick part is preferably 40% or less, especially 25% or less, of the maximum width W of the crown part 3. The maximum width W is preferably 3 to 45 mm, especially 10 to 25 mm.

Both a tip end portion 10*t* on the toe side of the thick part 10 and a tip end portion 10*h* on the heel side thereof reach the peripheral edge portion of the crown part 3. The distance c in the width direction between both the tip end portions is preferably 20 to 80%, especially 30 to 60%, of the maximum width W of the crown part 3.

The thicknesses of parts other than the thick part 10 of the crown part 3 are preferably 0.4 to 0.9 mm, especially 0.6 to 0.8 mm, on average, and the thickness of the thick part 10 is preferably 0.9 to 3.0 mm, especially 1.0 to 1.5 mm, on average.

The front half portion of the crown part 3 is preferably very slightly thinner than the rear half portion (excluding the thick part 10) so that the crown part 3 may be easy to deflect.

Specifically, the thickness of the range of the distance e from the foremost portion to the rear of the crown part 3 is preferably about 0.05 to 0.15 mm smaller than the thickness of the rear half portion. The thickness of the range of e is preferably 0.3 to 0.8 mm, especially about 0.5 to 0.7 mm, and the thickness of the rear half portion (excluding the thick part 10) is preferably 0.4 to 0.9 mm, especially 0.6 to 0.8 mm.

The golf club head 1 is formed by manufacturing a face plate and another part (a head body) separately in advance and by integrating these two parts by welding such as laser welding or plasma welding. The plasma welding and laser welding have a high energy density, and therefore can provide a weld having a deep penetration and good appearance with high accuracy as compared with TIG welding.

The hosel part 6 may be provided so as to reach the sole part 4 or may be provided so as not to reach the sole part 4. After welding, various finishing treatments such as grinding and painting are performed as necessary to obtain a product golf club head.

The head body is a casting, so that it can be manufactured easily even if having an intricate shape.

The face plate can be formed by any of casting, forging, and pressing. The face plate is provided with grooves (score lines) as necessary.

In this embodiment, both of the head body and the face plate are formed of titanium or a titanium alloy.

As the head body, Ti-6Al-4V or Ti-6Al-6V-2Sn, which is an α-β type titanium alloy, or Ti-8Al-1Mo-1V, which is a substantially a type titanium alloy, which has a modulus of longitudinal elasticity of 11,000 kgf/mm$^2$ ($107.8\times10^9$ Pa) or higher, is typically used. However, Ti-3Al-8V-6Cr-4Mo-4Zr or Ti-22V-4Al, which is a β type titanium alloy that is heat-treated so that the modulus of longitudinal elasticity is in this range, can also be used.

As the face plate, either of the aforementioned β type titanium alloy and α-β type titanium alloy may be used.

The golf club head that is especially effective in applying the present invention is a large golf club head having an easily deflectable crown part, specifically, a golf club head (driver) having a head volume of 250 cc or larger, preferably 300 cc or larger, and further preferably 350 cc or larger. The upper limit of volume is 460 cc as specified in the golf rules.

The thickness of the side part is preferably 0.5 to 1.2 mm, especially 0.7 to 1.0 mm, on average, and the thickness of the sole part 4 is preferably 0.5 to 1 mm, especially 0.6 to 0.9 mm, on average. The thickness of the face part 2 is preferably 2 to 3.5 mm, especially 2.7 to 3.2 mm, on average. The face part 2 preferably becomes thicker gradually from the peripheral edge portion to the central portion thereof.

For the golf club head 1 configured as described above, since the thick part 10 is provided in the central portion in the toe-heel direction of the rear portion of the crown part 3, the central portion in the width direction of the rear portion of the crown part 3 has a high rigidity, and the center of gravity of the golf club head 1 is located close to the rear in the rear portion. Therefore, the deflection of the crown part 3 at the time when a ball is hit by a position near the center of the face surface is restrained, and also the rebound coefficient is restrained. Also, the deflection of the crown part 3 at the time when a ball is hit by the toe side or the heel side of the face surface increases, and thereby a rebounding force can be secured. Also, since the center of gravity is deep, the sweet area is broad. Also, since the position of the center of gravity is high, backspin of some degree can be given to the ball.

For these reasons, even if the golf club head is used by an amateur golfer who often hits a ball by a hit point other than the center of face surface, the carry increases on average.

Also, in this embodiment, the range from the face part 2 to the front of the crown part 3 is thin as a whole, so that the rebounding force is sufficiently high within the range of limit placed by the golf rules, and therefore the carry increases.

In the above-described embodiment, the golf club head is formed by two bodies of face plate and head body. However, the golf club head may be formed by three or more bodies.

Figure 3:
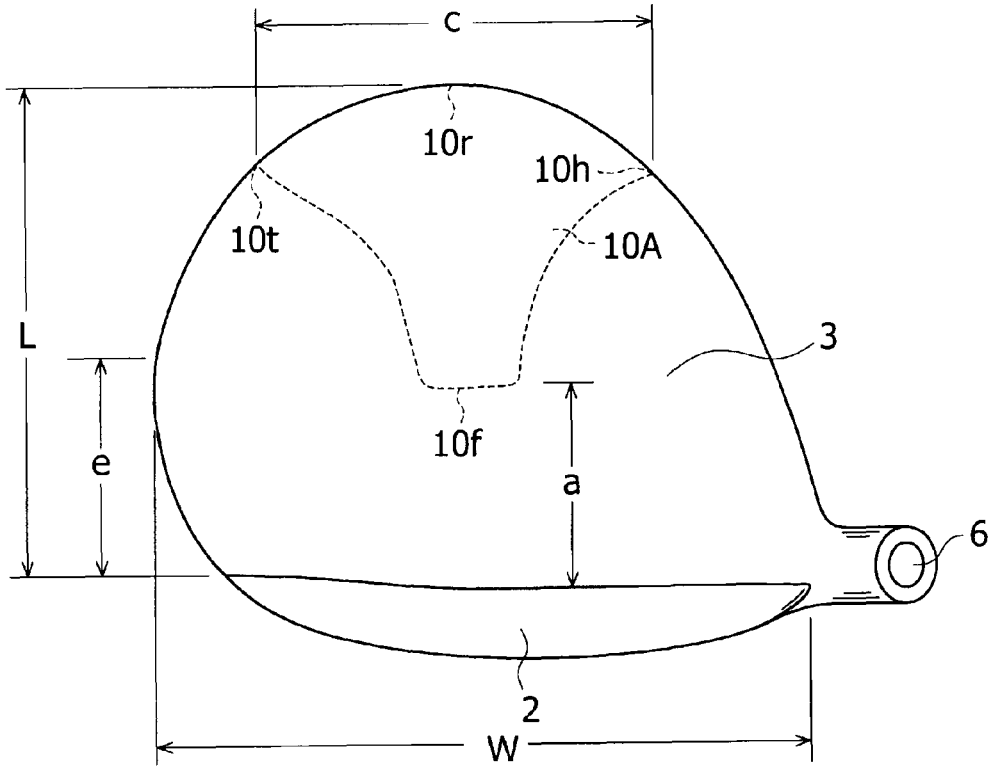
FIG. 3 is a plan view of a golf club head in accordance with another embodiment of the present invention.
Figure 4:
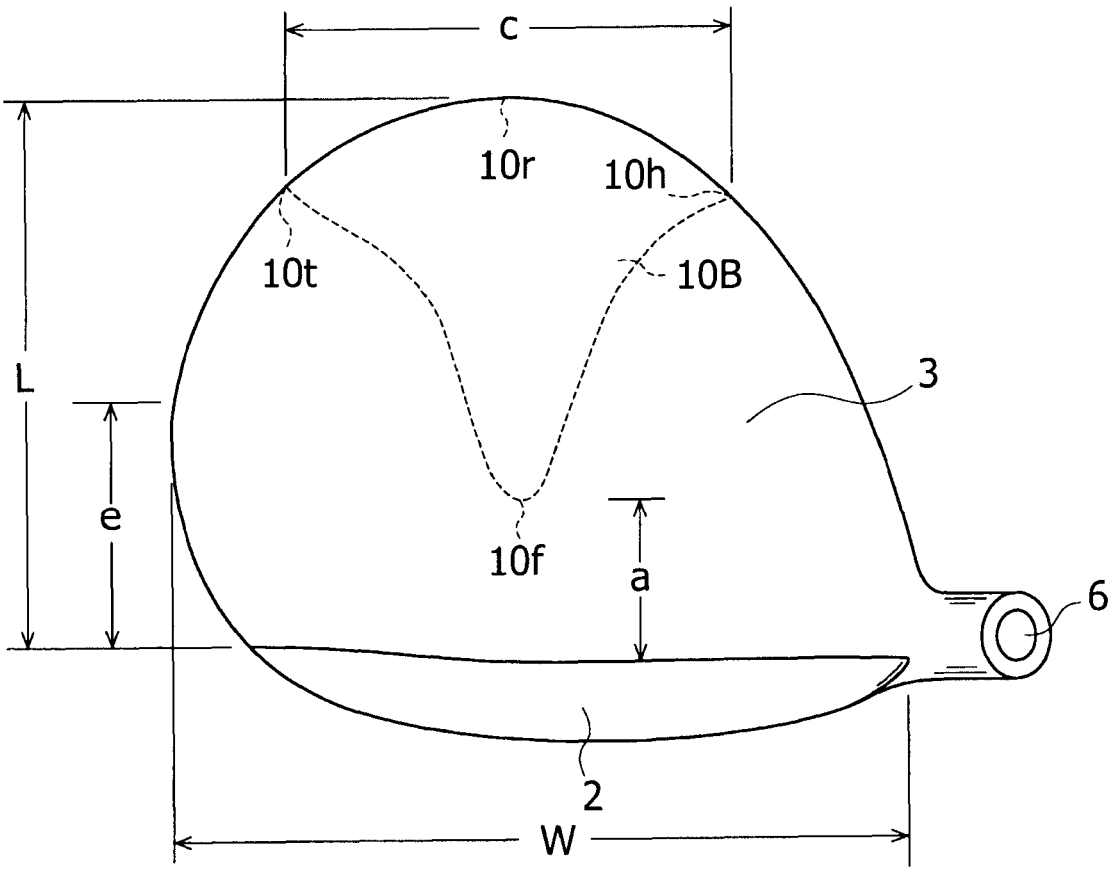
FIG. 4 is a plan view of a golf club head in accordance with still another embodiment of the present invention.

In the present invention, as shown in FIG. 3, a thick part 10A may be extended forward as compared with the thick part 10. Also, in the above-described embodiment, the thick part has a substantially trapezoidal shape. However, as shown in FIG. 4, a thick part 10B may have a substantially triangular shape such that b=0.

EXAMPLE 1

A golf club head having a volume of 460 cc, which is configured as shown in FIGS. 1 and 2, was manufactured. The head body was formed of (Ti-6Al-4V) α-β type titanium alloy manufactured by the investment casting process. The face plate 30 was manufactured by forging a β type titanium alloy. The modulus of elasticity of this titanium alloy is 110 Gpa.

The length L is equal to 92 mm, and the width W is equal to 125 mm.

The dimensions of the thick part 10 were as follows: d=40 mm, b=23 mm, and c=60 mm. The thickness of the thick part 10 was 1.0 mm. The thickness of the crown part 3 was 0.6 mm in the range of e=3.5 mm, and 0.7 mm in the rear half portion (excluding the thick part 10). The thicknesses of the side part 5 and the sole part 4 (excluding a thick part) were 0.8 mm and 0.9 mm, respectively. The face part 2 had a uniform thickness of 3.0 mm as a whole.

By attaching a shaft to this golf club head, a golf club was formed. The initial velocity, delivery angle, right delivery angle, amount of backspin, amount of sidespin, and carry of ball and a shift in the right and left direction at a ball drop point were measured at the time when a ball was hit by the face center and when a ball was hit with the hit position being shifted 10 mm and 20 mm to the toe side, at a head speed of 47 m/s, the approach angle (the angle of the golf club head just before hitting a golf ball) and the blow angle (the angle of the golf club head just after hitting the golf ball) being 0 degrees, using a swing robot manufactured by Miyamae Co., Ltd.

The measurement results are given in Table 1.

COMPARATIVE EXAMPLE 1

Measurement was made in the same way as Example 1 except that the crown part 3 had a uniform thickness of 0.9 mm. The measurement results are given in Table 1.

TABLE 1

| | | Initial velocity (m/sec) | Delivery (launch) angle (degree) | Right delivery (launch) angle (degree) | Backspin (rpm) | sidespin (rpm) | Carry (length) (m) | Right or left shift |
|---|---|---|---|---|---|---|---|---|
| Example 1 | Center | 66.3 | 7.5 | 0 | 2319 | 0 | 219.7 | 0 |
| | Toe 10 mm | 65.9 | 7.4 | 2.1 | 2372 | −226 | 217.2 | 1.2 |
| | Toe 20 mm | 64.4 | 7.3 | 4.4 | 2500 | −377 | 209.7 | 5.4 |

TABLE 1-continued

| | | Initial velocity (m/sec) | Delivery (launch) angle (degree) | Right delivery (launch) angle (degree) | Backspin (rpm) | sidespin (rpm) | Carry (length) (m) | Right or left shift |
|---|---|---|---|---|---|---|---|---|
| Comparative example 1 | Center | 66.2 | 7.2 | 0 | 2341 | 0 | 217.9 | 0 |
| | Toe 10 mm | 65.5 | 7.1 | 2.3 | 2406 | −274 | 213.9 | 0.7 |
| | Toe 20 mm | 63.8 | 7.0 | 4.7 | 2519 | −438 | 205.1 | 5 |

From Table 1, according to the present invention, it is recognized that even when a ball is hit by off-center, the carry is long. The actual hit evaluation of these golf clubs was performed. The evaluation result revealed that the golf club provided with the golf club head of Example 1 had smaller variations in carry. Also, the hit feeling was transmitted to the hand, and the hit feeling was good. Also, the hit sound was high and good.

The invention claimed is:

1. A golf club head which is metallic and hollow and has a face part, a sole part, a side part, and crown part, wherein:

a thick part, having an increased wall thickness, is provided in a central portion in the toe-heel direction of the rear portion of the crown part, the thick part has a rear side width, in a toe-heel direction, not less than 20% and not greater than 80% of a maximum width of the crown part, in a toe-heal direction, the width in the toe-heel direction of the thick part increases from the foremost portion of the thick part toward the rear portion of the crown part;

the average thickness of the crown part excluding the thick part is 0.4 to 0.9 mm, the average thickness of the thick part is 0.9 to 3.0 mm, and the difference therebetween is 0.2 to 2.5 mm, and in the plan view of the golf club head, the distance a between the front edge portion of the thick part and the foremost portion of the crown part is 20 to 80% of the length L in the front and rear direction of the crown part.

2. The golf club head according to claim 1, wherein the thick part reaches the peripheral edge portion on the rear side of the crown part, and a tip end portion on the toe side and a tip end portion on the heel side of the thick part are located in the peripheral edge portion of the crown part.

3. The golf club head according to claim 1, wherein the width of the foremost portion of the thick part is 3 to 40 mm.

4. The golf club head according to any claim 1, wherein the metal forming the golf club head is titanium or a titanium alloy.

* * * * *